United States Patent [19]

McIntyre

[11] 4,285,339

[45] Aug. 25, 1981

[54] ELECTRONIC CLOSED LOOP SERVOMECHANISM AND ELECTRONIC SCUBA REGULATOR THEREFOR

[76] Inventor: Robert T. McIntyre, 10706 Orchard St., Fairfax, Va. 22030

[21] Appl. No.: 74,711

[22] Filed: Sep. 12, 1979

Related U.S. Application Data

[63] Continuation-in-part of Ser. No. 60,818, Jul. 25, 1979, abandoned.

[51] Int. Cl.[3] ..... A62B 7/04

[52] U.S. Cl. ..... 128/204.23; 137/599; 128/205.24

[58] Field of Search ..... 128/204.21, 204.22, 128/204.23, 204.26, 204.29, 205.24; 137/101.19, 487.5, 599

[56] References Cited

U.S. PATENT DOCUMENTS

| | | | |
|---|---|---|---|
| 3,072,146 | 1/1963 | Gizeski | 137/599 X |
| 3,726,296 | 4/1973 | Friedland | 137/599 X |
| 3,741,208 | 6/1973 | Jonsson et al. | 128/204.21 |

FOREIGN PATENT DOCUMENTS

| | | | |
|---|---|---|---|
| 2910094 | 9/1979 | Fed. Rep. of Germany | 128/204.21 |

*Primary Examiner*—Henry J. Recla

*Attorney, Agent, or Firm*—Le Blanc, Nolan, Shur & Nies

[57] ABSTRACT

An electronic closed loop servomechanism for sensing a physical force such as ambient pressure and electronically powered means for performing useful work controlled by said servomechanism. The servomechanism may be used in a breathing gas system such as scuba employing a demand regulator wherein conventional mechanical control components of the demand system are replaced with the servomechanism, including differential pressure sensing and electronically driven components. Also, the servomechanism may be used in a breathing gas system employing a pressure step down, datum input type of regulator, as in a scuba first stage regulator, wherein conventional components of the first stage system are replaced with the datum-input controlled servomechanism, including differential pressure sensing and electronically driven components.

16 Claims, 17 Drawing Figures

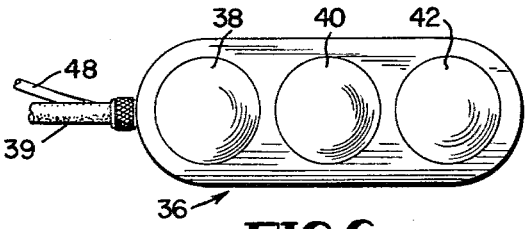
FIG. 6
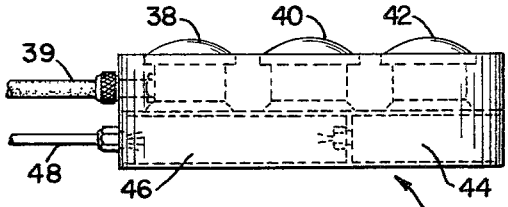
FIG. 7
FIG. 8
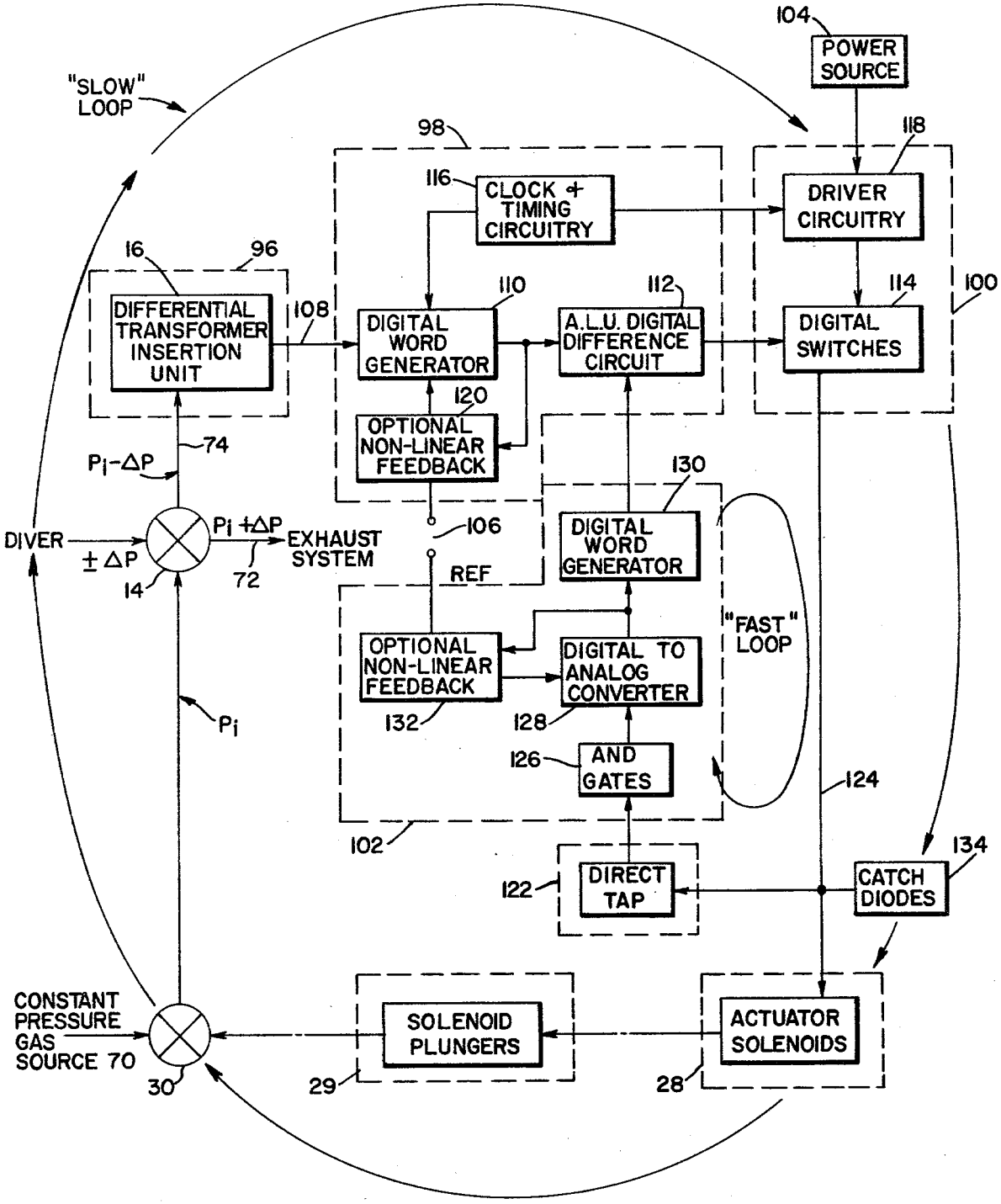

Fig. 12
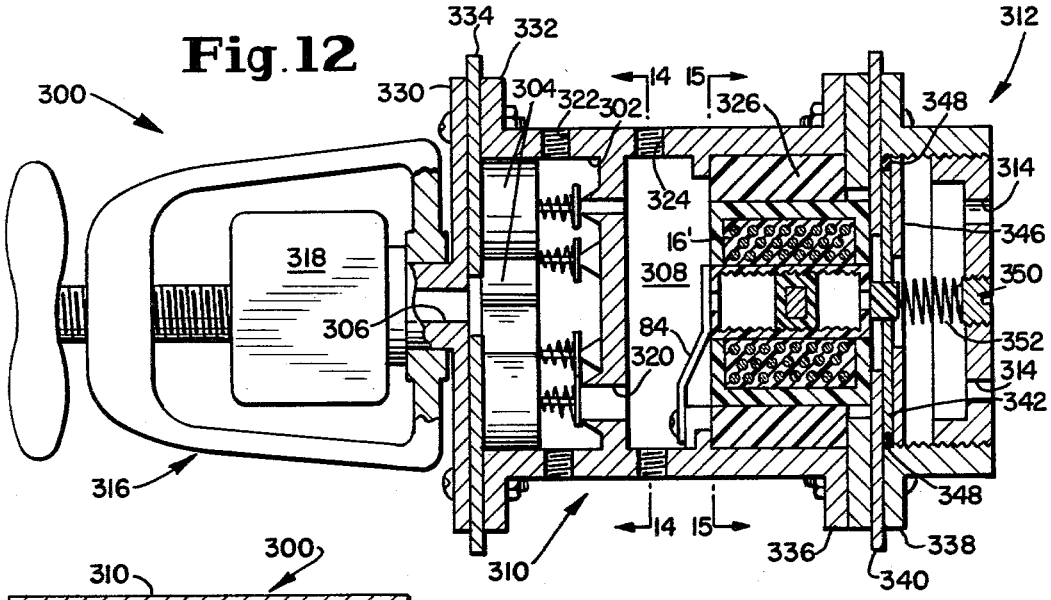
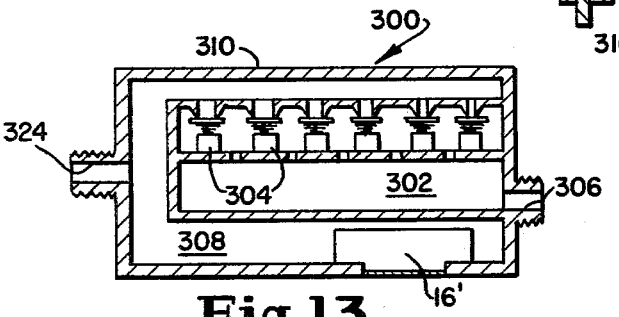
Fig. 13
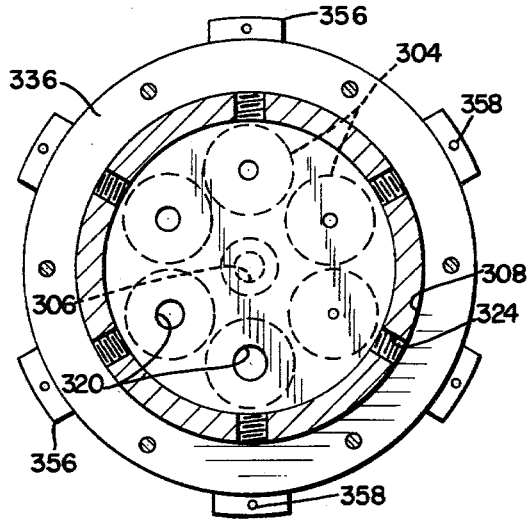
Fig. 14
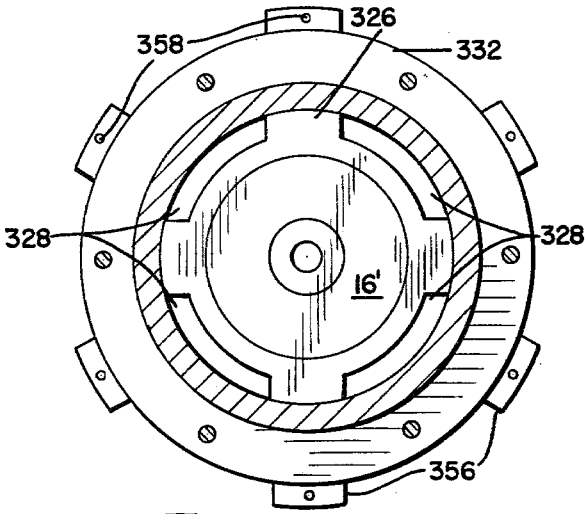
Fig. 15
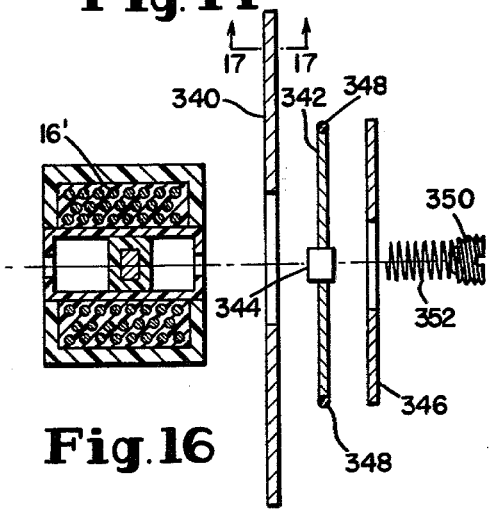
Fig. 16
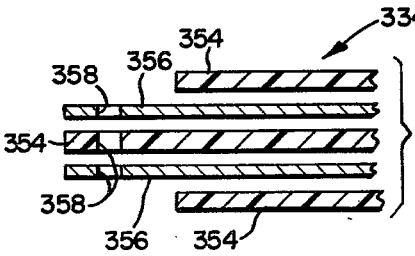
Fig. 17

ELECTRONIC CLOSED LOOP SERVOMECHANISM AND ELECTRONIC SCUBA REGULATOR THEREFOR

CROSS REFERENCE TO RELATED APPLICATION

This is a continuation-in-part of Ser. No. 60,818, filed July 25, 1979 now abandoned.

BACKGROUND OF THE INVENTION

The field of the invention is breathing gas systems employing a demand servomechanism to control or regulate the supply of breathing gas supplied to the user, and more particularly to an electronic servomechanism useful in a variety of applications and herein particularly useful for such a breathing system. The invention has significant utility in the fields of sport, scientific and commercial diving when scuba (self-contained underwater breathing apparatus) systems are employed, particularly as a replacement or substitute for the conventional demand servomechanism of the two stage, single hose regulator of an open circuit system. I prefer to denominate the entire apparatus an electronic scuba regulator or ESR.

Conventional mechanical scuba systems will be described only briefly. There are three categories of such systems: closed circuit; semi-closed circuit; and open circuit scuba. In the first two systems, the breathing medium is entirely reused or partially reused, after exhalation contaminants have been scrubbed. In open circuit systems, the breathing medium—compressed air in most cases—is exhausted into the surrounding water and is not reused at all. The embodiments of the invention disclosed in the following specification are particularly suited for open circuit scuba although the invention can certainly be used with semi-closed and closed systems.

There are two basic regulator designs in open circuit scuba. One is the two hose regulator and it may comprise one, two or more stages for reducing the tank pressure of the air supply down to a breathable, ambient pressure. The other design is a single hose regulator having two stages, most often. The first stage reduces pressure from the supply tank to a fixed pressure over ambient (usually 100–150 psi) and the second stage further reduces the pressure to breathable ambient pressure. Conventionally, the first stage is mounted on the valve assembly of the supply tank or tanks and the second stage includes a mouthpiece gripped by the user's teeth. A single relatively small diameter hose connects the two stages.

This second stage of a conventional, mechanical scuba regulator includes a demand valve, contact linked to a flexible diaphragm which defines one wall of a demand chamber or receiver unit. When the user breathes in through the aforementioned mouthpiece, a pressure differential or demand is created in the receiver. The diaphragm is thus caused to flex inwardly, due to relatively higher, outside ambient pressure. Subsequently, the demand valve of the second stage is opened, causing air to enter the receiver unit and thus flow to the mouthpiece and the user. Regardless of water depth, air is delivered on demand to the user since its supply and delivery is controlled by ambient pressure and user demand. Of course, if the pressure in the supply or tank falls to or below the ambient pressure, no air is delivered and the system is thus exhausted. The receiver unit is further equipped with one or more, one-way flap valves for exhaust purposes; upon exhalation, air is directed back through the receiver and out of the flap valve into the surrounding water.

A major drawback of the conventional, mechanical, two-stage single hose scuba regulator just described is the requirement for physical exertion or "demand" on the part of the diver or user in order to extract a breath from the system. While more modern engineering techniques have reduced the exertion levels required for both inhalation and exhalation down to rather acceptable levels, nevertheless an actual breathing resistance is felt, which increases with depth due to increasing density of the breathing air being delivered. Specifically, on inhalation, a diaphragm must be moved and a valve opened by force of inhalation. On exhalation, air must be forced back through a receiver unit into the surrounding water. Increasing air density with depth only compounds the difficulty.

Additionally, conventional second stages are rather bulky and fatigue the user's mouth after a period of use. Failures of the unit are rare but have occurred, leaving the diver at depth either without air at all or with a high pressure stream jetting through the second stage. A fractured or displaced diaphragm and/or malfunctioning exhaust valve can render the receiver unit full of water and dangerously unusable.

In summary, several significant deficiencies of mechanical scuba regulators can be noted:

(1) Significant breathing resistance, particularly under conditions of increased air density (greater depth);

(2) Excessive mouth-vicinity mass;

(3) Diaphragm size and fragility;

(4) Dangerous and unsafe under conditions of failure.

Representative prior art disclosures of mechanical scuba regulators are found in U.S. Pat. Nos. 2,523,906; 2,728,340; 2,854,001; 2,894,506; 2,902,031; 3,028,860 and 3,480,011.

The next advance in the art was to develop an electromechanical regulator that would overcome at least some of the noted breathing resistance problems, on inhalation and exhalation. The following three patents deal with regulator systems unrelated to diving, however. These include U.S. Pat. Nos. 3,368,212; 3,500,826 and 3,611,178. U.S. Pat. No. 3,368,212 issued to S. D. Klyce is simply a monitoring system, designed for use with an ill patient and includes an alarm system which is actuated when the patient's breathing rate falls below a predetermined value. U.S. Pat. No. 3,500,826 issued to C. A. Haire concerns an $O_2$ mask for an air-crew member employing a differential pressure transducer to read demand and a single solenoid actuator for providing $O_2$ in response to demand, the displacement of the solenoid plunger being continuously governed by the magnitude of current flowing in the coil, which in turn is controlled by the differential pressure transducer. U.S. Pat. No. 3,611,178 discloses an electrical assist for a respirator designed primarily for hospital use including a diaphragm with electrical means to sense demand and activate the respirator in response to such demand. In short, the invention therein disclosed is an electrical pilot valve. Prior U.S. Pat. Nos. 3,523,677; 3,586,287; 3,625,477; 3,770,018 and 3,817,488 each disclose electropneumatic devices or electromagnetic gas valves. U.S. Pat. No. 3,695,261 discloses means for converting a conventional open circuit scuba rig into a semi-closed system by incorporating an electronically controlled rebreather system and U.S. Pat. No. 3,794,059 discloses a closed or semi-closed scuba system employing an electronic monitoring control and display system in the breathing gas supply system.

However, the prior art fails to disclose the use of sensor technology in providing a power assist to the demand element in an underwater breathing apparatus. The present invention is further directed to providing electronic assistance to breathing in the underwater domain.

SUMMARY OF THE INVENTION

Therefore it is a primary object of this invention to provide an electronic closed loop servomechanism and underwater breathing apparatus therefor with a fully electronic sensing and control system for providing breathing gas to the diver upon demand but without necessity of physical exertion as in the case of mechanical underwater breathing systems.

It is an object of the invention to provide an electronic scuba regulator wherein demand is electronically sensed and the regulating mechanisms by which breathing air is delivered to the diver are electronically controlled.

It is another object of the invention to provide an electronic regulator wherein demand is transduced into an electrical error signal which in turn drives the electronics to activate the air supply mechanism.

It is also an object of the invention to provide an electronic scuba regulator wherein a differential about a datum level is electronically sensed and the regulating mechanisms by which intermediate air pressure is adjusted are electronically controlled.

Generally stated, the electronic servomechanism and regulator of the present invention include: First, means for electrically observing a physical force such as negative pressure differential generated within a single hose, scuba regulator above described; second, processing electronics which read the electrical observation of the negative pressure differential as an input error and convert it to be further used as a control; third, electronically powered means for performing useful work such as driver electronics to power the prime mover (e.g., scuba regulator second stage demand valve), the driver electronics being basically powered by a suitable source such as a battery or generator, and then modified by the signal generated by the processing electronics—the resultant open loop response must be conditioned by the output signal to be useful; fourth, closed loop response, utilized to reduce the magnitude of the input error—more simply stated, a portion of the open-loop response is utilized to operate on the input signal and thus close the system loops. Of course, the more quickly the described closed loop servomechanism system comes to stability as it nullifies input error, the better the system.

These and other objects and advantages of the present invention will become readily apparent by considering the following specification and drawings.

BRIEF DESCRIPTION OF THE DRAWINGS

FIG. 6 is a plan view of a conventional diver's console modified to mount the necessary electronics and power source (batteries) for the ESR;

FIG. 7 is an elevation view of the console shown in FIG. 6;

FIG. 8 is a general block diagram of one embodiment of an ESR;

FIG. 12 is a cross-section view of a first stage embodiment of an electronic scuba regulator or ESR showing a conventional, cylindrical first stage of the regulator modified according to the teachings of this invention;

FIG. 13 is a section, schematic view of the embodiment of the invention shown in FIG. 12 and illustrating the operation thereof;

FIGS. 14 and 15 are section views taken along lines 14—14 and 15—15 respectively of FIG. 12;

FIG. 16 is a partial subassembly, exploded view of components illustrated at the right side of FIG. 16; and FIG. 17 is a section view taken along lines 17—17 of FIG. 16 and drawn to an enlarged scale.

DESCRIPTION OF THE PREFERRED EMBODIMENTS

Figure 1:
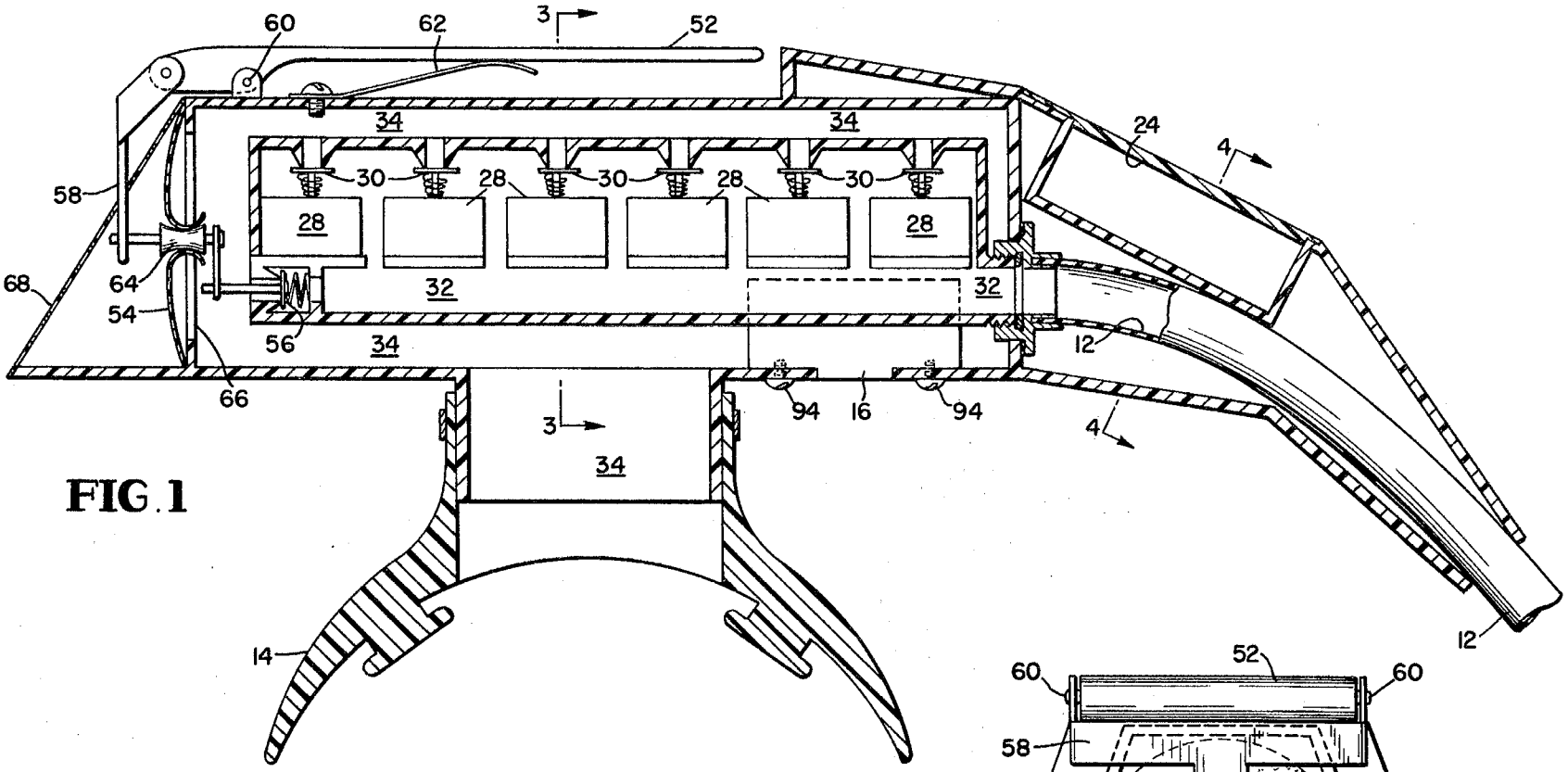
FIG. 1 is a cross-section schematic view of a preferred embodiment of an electronic scuba regulator or ESR showing a conventional second stage scuba regulator modified according to the teachings of this invention whereby the conventional diaphragm and the conventional second stage demand valve are replaced by an electronic differential pressure sensor and a series of six solenoid controlled valves for admitting air to the receiver unit of the second stage.
Figure 3:
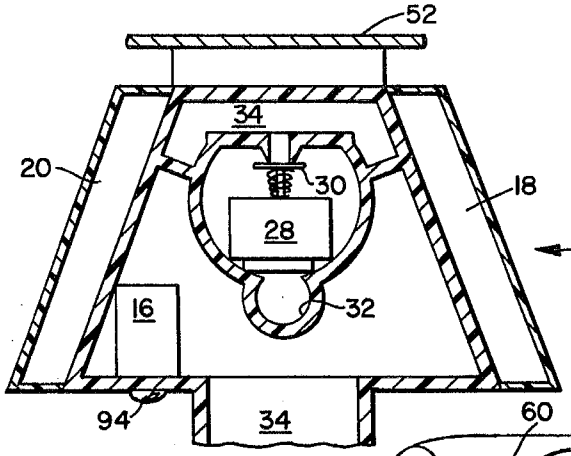

The second stage 10 of an otherwise conventional single hose, two stage regulator is shown in FIG. 1, together with its air supply hose 12 to which air is supplied by a conventional tank and regulator first stage (not shown). A mouthpiece 14 is illustrated for supplying air to the diver. The conventional diaphragm is eliminated and replaced by an insertion unit 16 containing a differential transformer pressure sensor/transducer. The terminology can be shortened to differential transformer insertion unit or DTIU. In any event, DTIU 16 senses pressure demand within second stage 10 created by an attempted inspiration by the diver acting on mouthpiece 14. The signal is then transmitted to processing, driver and feedback electronics which are microminiaturized to conveniently fit within one or perhaps both second stage skirt chambers 18, 20 provided as integral parts on the top and bottom, respectively, of second stage 10, as is illustrated in FIG. 3.

Figure 4:
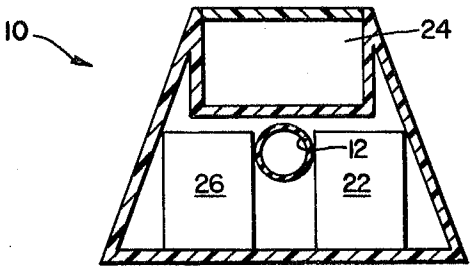
FIGS. 3 and 4 are section views taken along lines 3—3 and 4—4 of FIG. 1, respectively.

Power is supplied from suitable batteries which are mounted in chambers 22, 24 and 26 provided at the right hand side of second stage 10, as is shown in FIGS. 1 and 4. The driver electronics are in the form of six solenoids 28 used to open and close one or more complementary valves 30 to provide air from the upstream side 32 of second stage 10, where pressure is ambient plus 100–150 psi, to the downstream side 34, in response to diver demand at mouthpiece 14. Here, of course, air will be at ambient pressure. The valves 30 are illustrated as upstream valves; they could be fail-safe downstream valves so that in the event of some mechanical failure, one or more of such valves would be forced to an open, free flow position.

It should be noted that for purposes of illustration, solenoids 28 and valves 30 are shown in greatly enlarged proportion to the remainder of chamber 10. In practice, these members would be far smaller than shown.

In this preferred embodiment, microminiaturized digital electronics are employed. Thus, metalization output requirements are minimal. The six solenoids 28 will probably require more power than all of the circuitry—likely on the order of 200–300 milliwatts. Additionally, since the driver electronics load comprises solenoid coils, these are apt to require power at 20 volts rather than the standard 10 volt requirement for the CMOS circuitry of the remaining electronics. Consequently, spaces 22, 24 and 26 may be used to individually house the several batteries required.

Figure 5:
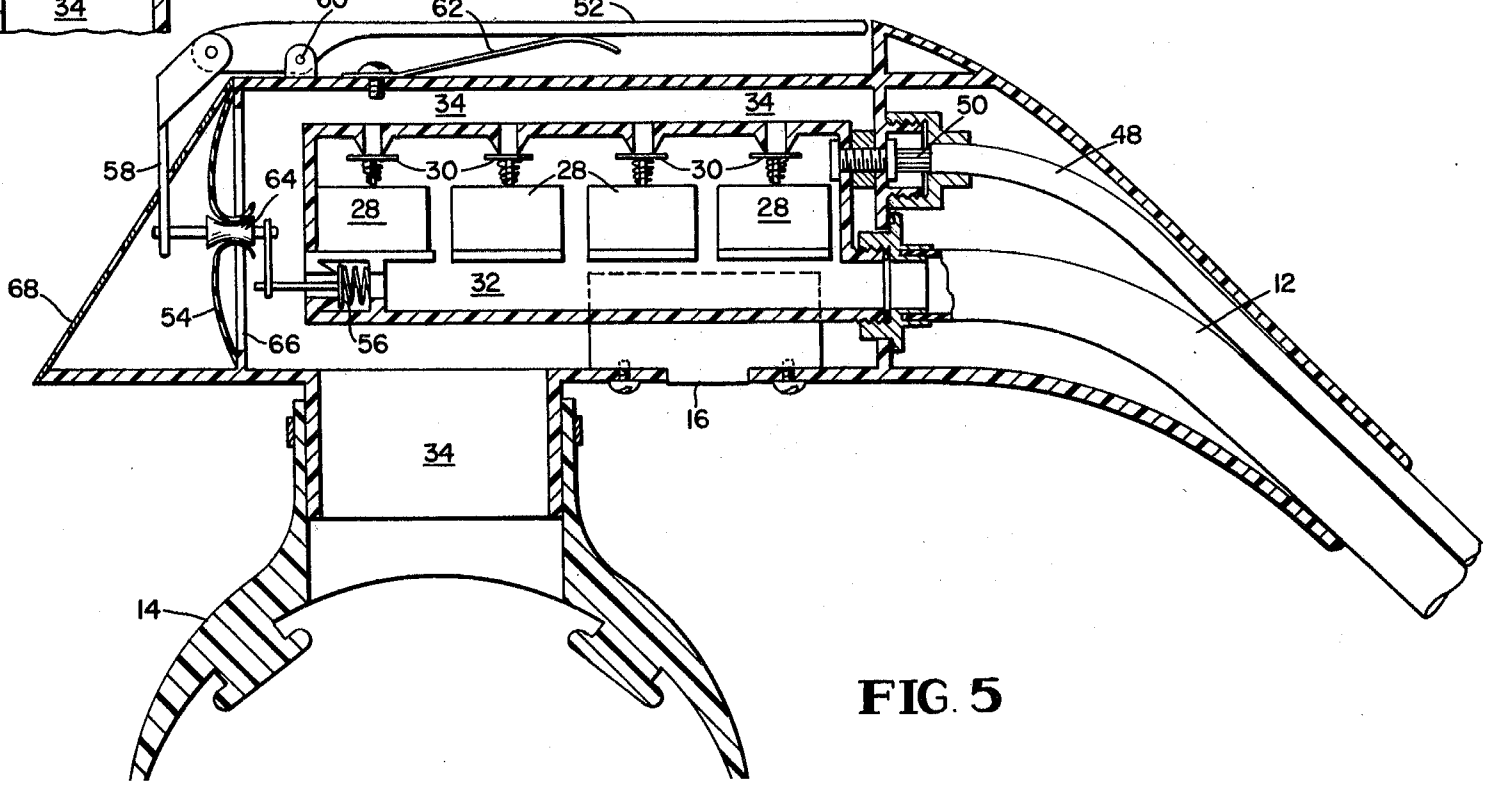
FIG. 5 is a section view similar to FIG. 1 but showing only four solenoid controlled valves for admitting air to the receiver unit of the regulator second stage.

In the embodiment shown in FIG. 5, only four solenoids 28 are used instead of six as in the preferred embodiment. A detailed explanation for the difference in structure will be set forth below. Basically, a smoother flow is provided by the six solenoid-valve arrangement of FIG. 1 than the four solenoid-valve arrangement for the electronics and batteries. If the electronics components are not microminiaturized as in the embodiment of FIG. 1, then they will need to be stored elsewhere, as in the base of a standard diver's console 36 (FIGS. 6 and 7). Such a console includes a submersible pressure gauge or SPG 38, a depth gauge 40 and perhaps a compass 42. Batteries can be stored at 44 and the electronics can be stored in chamber 46.

Chambers 44 and 46 are constructed as two separate pressure housings so that if battery housing 44 floods, the electronics in housing 46 will remain dry.

The electronics may be connected to solenoids 28 via an umbilical line 48 running along a high pressure air supply line 39 for SPG 38 to the regulator first stage (not shown) and then along line 12 to second stage 10. (Wiring from terminal 50 of umbilical 48 to the several solenoids 28 is not illustrated in order to enhance the clarity of FIG. 5).

Figure 2:
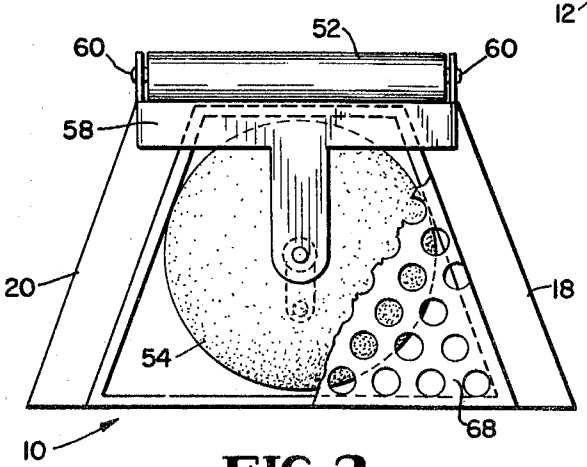
FIG. 2 is an end view, partly in section, taken from the left hand side of FIG. 1.

The standard purge button and exhaust valve or valves of a conventional single hose regulator second stage are replaced by a purge bar or lever 52 and an exhaust valve 54, respectively, in both of the embodiments shown in FIGS. 1 and 5. A tilt valve 56 for purging is connected by suitable linkage 58 to bar 52, which is pivotally mounted at 60 and is leaf-spring urged at 62 to a tilt valve closed position as illustrated in FIGS. 1 and 5. Exhaust valve 54 is a flap valve, centrally opened to receive a spool 64 therethrough in water tight relationship, spool 64 having a part of linkage 58 passing therewithin. Spool 64 and exhaust valve 64 are maintained in place by a spider 66 which may be formed as a part of second stage 10. An external perforated plastic cover or cage 68 (FIG. 2) protects these parts from damage and/or inadvertent unseating.

Figure 9:
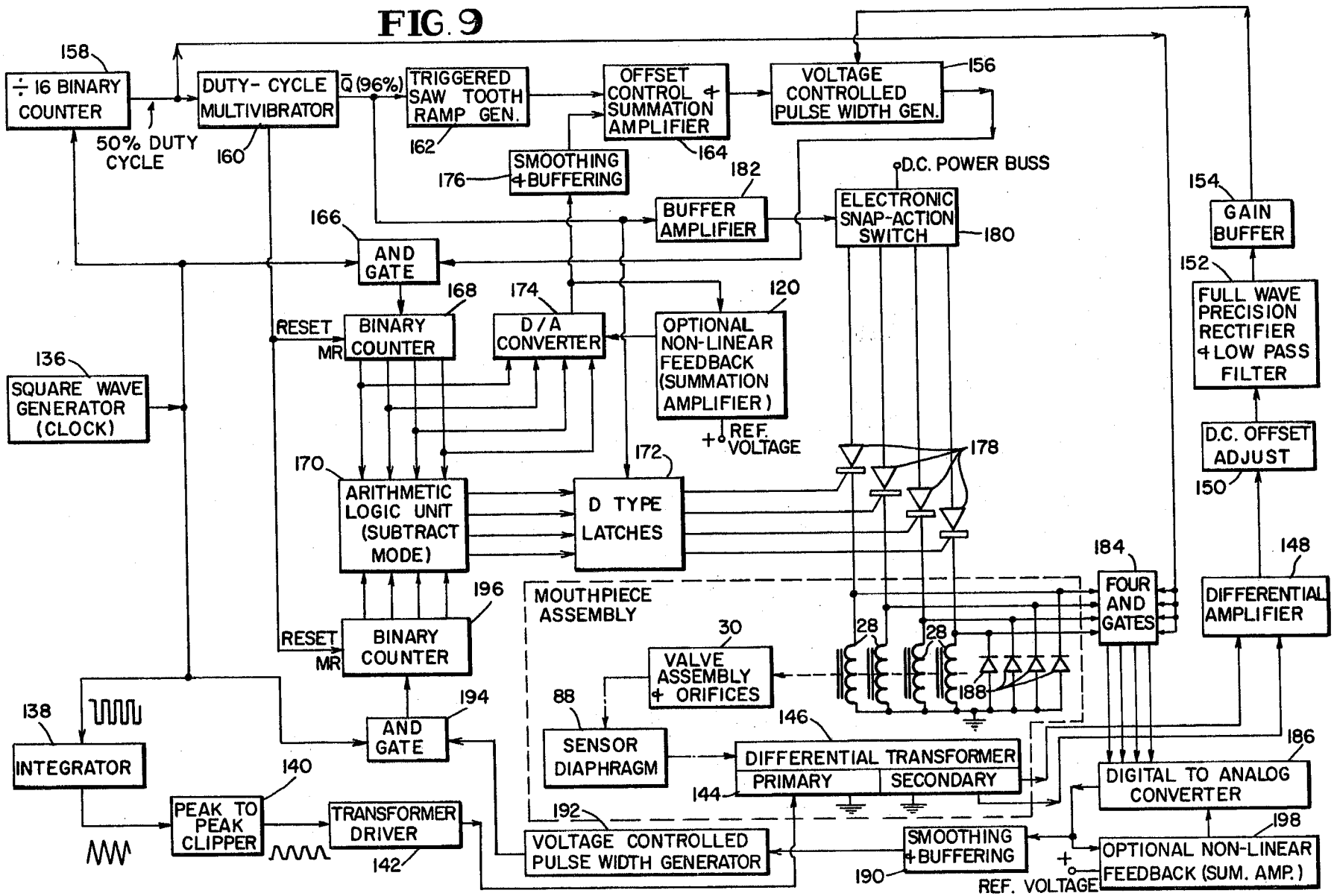
FIG. 9 is a more detailed block diagram of the embodiment disclosed in FIG. 8.

Turning now to FIGS. 8–11, embodiments of the processing, feedback and driver electronics will be discussed in detail. The essentials of the electronics include DTIU 16 (FIG. 11), which senses diver demand and translates that demand into a control signal, a digital word addressed, digitally activated valve actuator assembly of six solenoids (FIG. 1) or four solenoids (FIG. 5) and processing electronics, configured either as a six-bit (or four-bit) word Arithmetic Logic Unit (ALU), illustrated in FIG. 9, or a stochastic-ergodic random variable running difference arrangement (FIG. 10) for error detection. A more generalized electronic diagram for the embodiment of FIG. 9 is illustrated in FIG. 8.

In any event, the key to the ESR is the all digital design provided, in place of analog methodology and design. Analog designs required analog actuators which are expensive, difficult to design and must be either electronically commutated, or of limited stroke (or rotation) to remain operable when flooded. Analog circuits are notoriously susceptible to thermal variations and require extensive "twiddling" of controls to establish a satisfactory set point.

Conversely, digital circuitry in the context of the instant invention provides several distinct advantages. First, it is thermally and gain insensitive. Second, the all-on, all-off modes eliminate the need for linear compensators or controllers. Third, digital circuitry can be interfaced into either digital or analog actuators. Incidentally, a digital actuator is easy to index, is programmable and is not difficult to incorporate into an assortment of valving arrangements. Fourth, a digital design permits utilization of stochastic variable techniques (FIG. 10) which employ noise generators and random ensemble, average and ergodic measures. Thus, they are insensitive to disturbances which would render straight logic digital designs inoperative.

The essentials of the ESR are as follows: First, a demand sensor mechanically responds to diver created demand within the second stage 10 and outputs an electrical error signal. Second, processing electronics receive the error signal and translate it into a form whereby it can produce useful work. Third, driver electronics provide a power response to the signal derived from the processing electronics. Fourth, the driver electronics open air valves to provide air to the diver. At this point, an instability is created because of pneumatic delay necessitated by the mechanical structure of the air valves. Hence, the demand sensor will generate larger and larger output signals, leading to a runaway airblast instability, unless controlled. A long period of trial and error led to the discovery that an electrical feedback is needed to "outrun" the pneumatic feedback and thus stabilize the processing-driver electronics. Or, simply stated, a "fast loop" is needed to control the "slow loop" and this I call "loop slaving".

Figure 10:
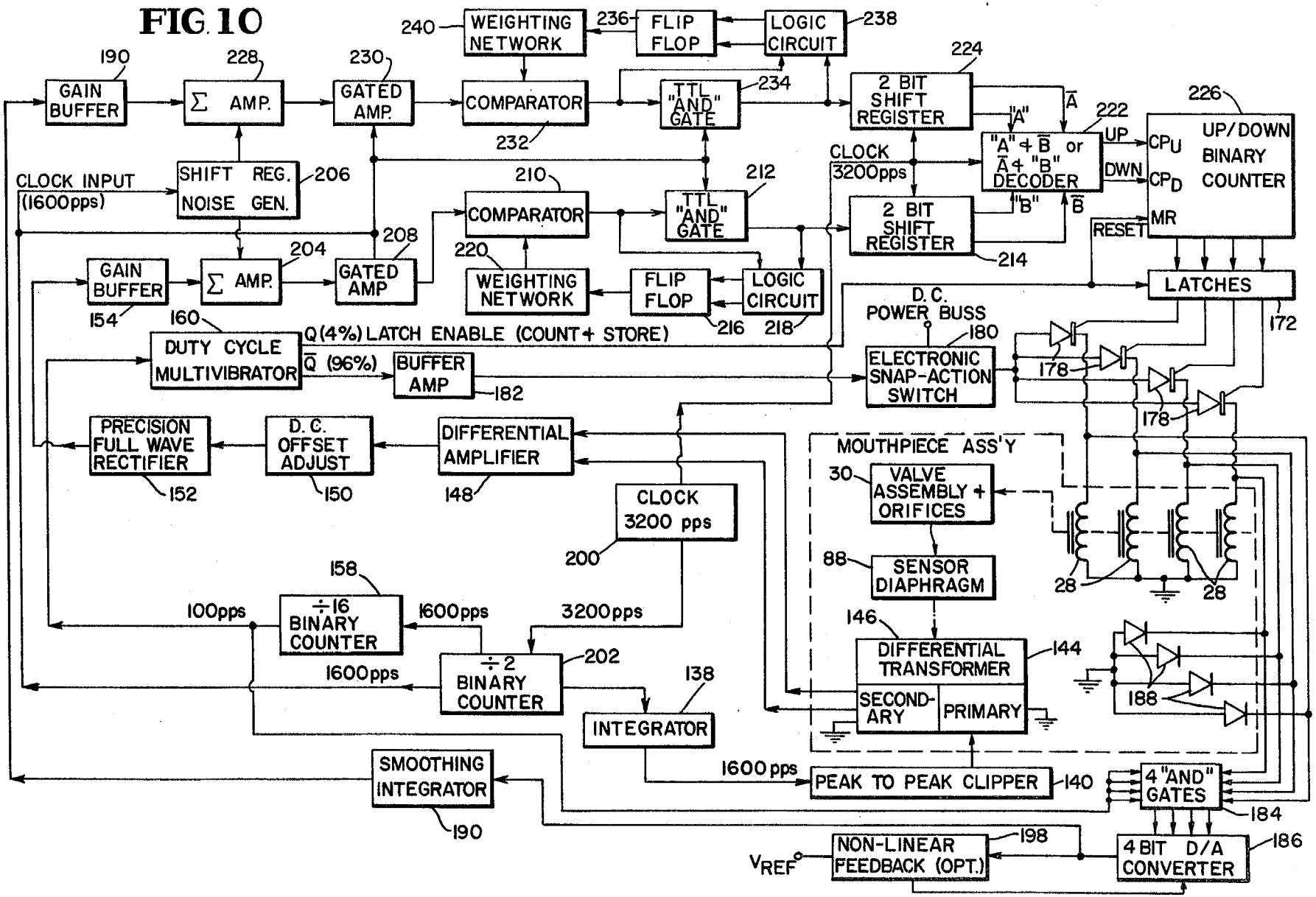
FIG. 10 is a detailed block diagram of another embodiment of an ESR.

Turning now to FIG. 8, the basic components of a digital Electronic Scuba Regulator (ESR) using an Arithmetic Logic Unit (ALU) for detection of loop error (the electrical feedback discussed above) will be discussed; FIG. 9 discloses this embodiment in even greater detail. The embodiment shown in FIG. 10 is another digital ESR using random variable logic or stochastic-ergodic measures for detection of loop error rather than an ALU.

A constant pressure gas source is indicated at 70 which will be downstream from the first stage of a scuba regulator (not shown) in the range of about 100–150 psi over ambient pressure as previously set forth in some detail. In the embodiment of FIG. 1, hose 12 provides that gas (in this case, compressed air) to chamber 32.

Air then supplied through valves 30 enters chamber 34 and regulator mouthpiece 14 at ambient pressure. This pressure is denominated $P_i$ in the Figure. A diver provides demand at mouthpiece 14 in the form of a change in pressure in chamber 34, or $\Delta P$. The $\Delta P$ is negative if the diver inhales and is positive when the diver exhales. Adding in $P_i$, we have $P_i+\Delta P$ as shown at 72 when the diver exhales; the $+\Delta P$ is vented off through the exhaust system (valve 54, for example, in the case of the FIG. 1 embodiment). Upon diver inspiration, negative $\Delta P$ is created whereby $P_i-\Delta P$ is the result, as shown at 74, and now the DTIU 16 functions to sense $-\Delta P$.

Figure 11:
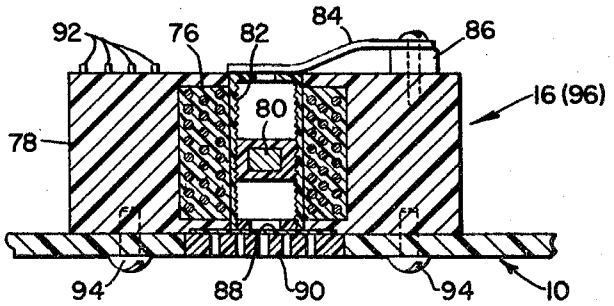
FIG. 11 is a section view showing an embodiment of the initial demand sensor and signal transmitter.

Attention for the moment will now be diverted to FIG. 11 wherein an embodiment of a DTIU 16 is illustrated. Unit 16 is a differential transformer pressure sensor/transducer and includes differential transformer windings 76 epoxy coated and glued within a plastic form 78. An epoxy coated iron slug 80 is threadably received within a movable cylindrical housing 82. The threaded interconnection allows for adjustable displacement of slug 80 within housing 82, as by a screwdriver (not shown). A retaining supporting leaf-spring 84 mounted at 86 retains housing 82 and slug 80 in place, interiorally of the regulator second stage (FIG. 1). The opposite or exposed to water end of housing 82 abuts against a sealing plastic diaphragm 88, protected and retained in place by a plastic diaphragm cage 90. Terminals 92 conveying the signal to the processing electronics and the whole unit 16 may be mounted in place by suitable means such as screws 94.

Upon diver inspiration, negative $\Delta P$ within the regulator second stage 10 causes diaphragm 88 to flex slightly inwardly, thus moving housing 82 and its slug 80 causing the voltage induced in the differential transformer 76 secondary from the primary to become unbalanced. Consequently, an alternating signal is produced which is passed to the processing electronics.

The particular demand sensor 96 disclosed (the DTIU 16) is but one example of a wide variety of such sensors. For example, strain gauges, piezo-electric crystals, other differential transformers, photoelectric devices, pressure sensitive transistors, displacement variable capacitors and so forth might be used instead.

Returning now to FIG. 8, processing electronics 98 converts the signal received from demand sensor 96 into a form to do useful work. Driver electronics 100 are controlled from 98 to actuate the driver elements—the solenoids 28 and their associated plungers 29 to thus open valves 30 and provide air to the diver. These are the essential components of the "slow loop" portion of the ESR, meaning those elements employed to open the air valves. As was explained above, the mechanical, pneumatic part of the system cannot react quickly enough to the electronic signals being generated and processed and thus the system must be controlled by either a pneumatic or electronic-pneumatic feedback to prevent a runaway, air blast instability. I employ a pneumatic plus electronic feedback, the electronics are indicated at 102. This I call a "fast loop". Thus, the "fast loop" controls the "slow loop" and the phenomenon is called "loop slaving".

A power source is indicated at 104 and is stored at 25 (FIG. 1) or 44 (FIG. 7) as previously explained. A reference voltage is thus provided at 106. The signal 108 from sensor 96 is converted into a digital word at 110 and is fed to arithmetic logic unit digital difference circuit 112 which in turn controls the digital switches 114 of driver electronics 100. Clock and timing circuitry is provided at 116 for word generator 110 and driver circuitry 118 of drive electronics 100. An optional non-linear feedback in the form of a summation amplifier may be provided at 120.

Signal generation for the feedback electronics is accomplished by a direct tap 122 in the power signal 124 driving solenoids 28. The feedback signal is processed through AND gates 126 to digital-to-analog converter 128 and digital word generator 130 to control ALU 112 and thus control the driver electronics 100. Again, an optional, non-linear feedback in the form of a summation amplifier may be provided at 132.

Catch diodes are provided at 134 to prevent high voltage damage to components of the driver electronics 100.

Turning now to FIG. 9, a more detailed explanation of the circuitry very generally block diagrammed in FIG. 8 will be discussed in greater detail. Clock 136 drives integrator 138, whose output wave is clipped at 140 and then directed via transformer driver 142 to drive the primary winding 144 of the differential transformer 146 of DTIU 16. When unbalanced by diver demand, an alternating current is produced whereas in a quiescent state, no net secondary voltage is produced. This completes the demand sensing electronics.

The signal is now amplified at 148 and any quiescent direct current is adjusted out at 150. The signal is then rectified at 152, buffered at 154 and fed to a voltage controlled pulse width generator (VCPWG) 156.

VCPWG 156 is made synchronous with clock 136 by a divide-by-16 binary counter 158 and a duty cycle multivibrator 160, with its triggered sawtooth ramp generator 162 and DC offset adjustment and summation amplifier 164. Accordingly, the pulse width delivered to AND gate 166 from VCPWG 156 will be synchronous with clock 136.

Subsequently, AND gate 166 will pass 0–15 clock pulses on to binary counter 168, the generated word number being dependent upon the width of the pulse from VCPWG 156, which is a true reflection of diver demand.

The generated word then is passed to arithmetic logic unit 170. This particular unit is a high speed combinatorial circuit which performs addition, subtraction and several logic functions on two 4-bit words. It is set in the "subtract" mode to subtract from the binary input another binary input (which is provided by the feedback electronics 102 in a manner to be set forth below).

The resultant difference binary word is now sent to D type latches 172 which are count-and-store commanded from duty cycle multivibrator 160. This completes the processing electronics, with the exception of the optional non-linear feedback in the form of a summation amplifier 120 which is used to compress the scale and thereby solve the quantization error problem (of course, the other solution would be to go to a high-bit word system). Amplifier 120 per se is merely a typical encoder modification. Remaining components include digital-to-analog converter 174, which receives its binary word from binary counter 168. After scale compression by amplifier 120, the result is smoothed and buffered at 176 and then fed to DC offset adjustment and summation amplifier 164.

The output word from latches 172 is fed to the gates of SCR's 178, which function as the digital power switches for solenoids 28. Electronic snap-action switch 180 is made synchronous with counter 168 and ALU 120 because it draws input from duty cycle multivibrator 160 through a buffer amplifier 182. Multivibrator 160 is set so that the anodes of SCR's 178 are provided with DC power for 96% of each cycle. (The remaining 4% is used to reset counters, enable latches and turn off SCR's.) Thus, when the anodes of SCR's 178 are provided with voltage, they will pass power to solenoids 28 provided their gates have been energized. This completes driver electronics 100.

Feedback electronics 102 will now be discussed in detail. Direct taps 122 are made at the cathode of each SCR 178 and directed to AND gates 184 where the duty cycle is simultaneously reduced to 50% for driving a 4-bit digital-to-analog converter 186. The output of gates 184 is synchronous and at 50% duty cycle because the other sides of the gates 184 are provided with voltage from the divide-by-sixteen binary counter 158, as shown.

Since the cessation of current in solenoids 28 causes a back EMF opposite in sign to that used to energize the solenoid coils, which may be at considerably higher voltage through the main power supply (depending on coil inductance), a series of catch diodes 188 are provided which will not allow inductive kick to rise more than 0.6 volts negative. Negative inductive kick currents are merely passed to ground as shown.

The analog signal emanated from digital to analog converter 186 is adjusted for DC offset (not shown), smoothed and buffered to prevent loading at 190 and then drives another VCPWG 192, which is a duplicate of VCPWG 156 in the slow loop. Similarly, AND gate 194 and binary counter 196 are the same as gate 166 and counter 168, in the slow loop, respectively. Error reduction by scale compression is provided by another non-linear feedback summation amplifier 198 which functions in exactly the same manner as amplifier 120. Thus, ALU 170 performs the differencing, always one duty cycle in time behind the fast loop between signals received from counters 168, 196 and thereby controls the solenoids and prevents a runaway, air blast instability.

In addition to the just described electronic feedback control, there is a pneumatic assist as well in preventing air blast instability. Opening and closing of solenoids 28 provides a pneumatic feedback within second stage chamber 34 to diaphragm 88 and thus sensor 16. Electrically speaking, however, this mechanical feedback is countless cycles behind the "fast" loop. In preferred embodiment, clock 136 generates 1600 pps; provision of counter 158 results in 100 duty cycles per second. Accordingly, pneumatically speaking, solenoid actuation is varied by very small amounts in controlling air blast instability.

An embodiment of the invention employing the random variable technique of error detection, or stochastic-ergodic measure is block diagrammed in FIG. 10. The demand sensor 16 and its electronics are precisely the same as in the embodiment disclosed in FIG. 9. The generated alternating current signal is then amplified and rectified (after adjusting out any direct current) and buffered in the same manner as the previous embodiment. At this point, the embodiment departs in principle and operation from that set forth in FIGS. 8 and 9 and explained in detail above.

The clock 200 or square wave generator in this embodiment outputs 3200 pps; a divide-by-two binary counter 202 is provided in advance of divide-by-sixteen counter 158 so as to provide the 100 duty cycles per second format as in the previous embodiment.

A summation amplifier 204 is driven by the amplified signal received from gain buffer 154 and also by shift register noise generator 206. In a preferred embodiment, it is a 31 stage noise generator common in spread-spectrum communication and RADAR systems. By preserving DC level, the random wave generated will have an equal probability of being above or below the average. This noise-plus-DC is summed at 204 with the DC input from 154 to output a DC modulated noise signal.

The signal is gated at 208 at 1/16 the master clock rate. The resultant output is fed to comparator 210; when in excess of the comparator threshold, a fixed amplitude pulse is then delivered to TTL AND gate 212, which is synchronous with gated amplifier 208. Gate 212 delivers a pulse to 2-bit shift register 214 only when a pulse appears on both inputs of gate 212 simultaneously. Thus, gate 212 acts as a buffer to comparator 210 and reproduces the time sequence of pulses synchronous with clock 200, after divide-by-2 counter 202 (1600) pps).

Now, the existence of output signals or a random binary sequence depends, of course, on the magnitude of the DC output from sensor 16. In this embodiment, it is desirable to control the probability of a comparator transition occurring (and hence the number of pulses in the random binary sequence) by a given reference level of input signal from sensor 16. One method of doing this is to vary the DC reference level at the comparator.

A JK or master-slave type of flip-flop 216 is clocked by logic circuit 218 (which consists of an AND gate and a pair of inverters). Flip-flop 216 is clocked "set" for a pulse and "reset" for no pulse. A simple resistive weighting network 220 controls the probability of comparator 210 transition and may include a pair of potentiometers, one pot setting flip-flop 216 Q output ratio of voltage feedback and another pot setting the $\overline{Q}$ output; the two are simply summed at a diode junction to set the comparator threshold.

The generated random binary sequence is now presented to a synchronization and coincident pulse prevention circuit, including 2 bit shift register 214 and decoder 222. Register 214 converts the serial-in random binary sequence into a 2 bit parallel-out binary word; it is a serial-in, parallel-out or SIPO register. A typical SIPO here would be four cascaded D-type flip-flops. These are pair packaged into UP and DOWN labels and presented to a decision network command logic or decoder 222. The logic of decoder 222 is: (1) with simultaneous UP, DOWN input, nothing happens; (2) with DOWN input only, delivers a DOWN command; and (3) with UP input only, delivers an UP command.

Since the register is a 2 stage flip-flop, it must be clocked at a rate at least twice that of the DOWN or UP inputs, or at 3200 pps in this case to prevent loss of any input pulses.

A second 2-bit shift register 224 is driven from the feedback electronics in a manner to be described in detail below. Decoder 222 comprises three, four-input AND gates which receive information from the dual 2-bit registers 214, 224, and decode and gate it with the clock to produce simultaneous DOWN and UP commands. For example, a low-to-high transition on the DOWN input produces a decreasing value, a 4-bit binary word while a low-to-high transition on the UP input produces an increasing value, 4-bit binary word. After decoding and gating with the clock, these transitions can be used to decrement and increment, respectively, a binary counter 226. The third AND gate of decoder 222 disables both UP and DOWN commands to counter 226 when the DOWN or UP transitions occurs simultaneously.

The essentials of the feedback electronics are the same as in the embodiments disclosed in FIGS. 8 and 9. The output signal is then processed in precisely the same manner as the signal derived from sensor 16. Specifically, the signal drives a summation amplifier 228 which is also driven by noise generator 206. The result is gated at 230 and fed to comparator 232; when in excess of the comparator threshold, a fixed amplitude pulse is delivered to TTL AND gate 234 and to 2-bit shift register 224, when a pulse appears on both outputs of gate 234 simultaneously. The comparator 232 threshold is controlled from the pickoff 122 (FIG. 8) driving one side of the AND gates 184 by flip-flop 236, regulated by logic circuit 238 to set resistive network 240 which then sets the comparator 232 threshold.

Accordingly, in this embodiment the UP input can be driven by the demand sensing electronics (slow loop) while the DOWN input is derived from the feedback electronics (fast loop). Thus, a 4-bit digital word is derived which represents (on average) the difference between demand and electronic response. Since the process occurs simultaneously in the UP and DOWN channels the output of counter 226 represents a running difference. This is stored in latches 172 in precisely the same manner as set forth in the embodiment disclosed in FIGS. 8 and 9. The remaining components (driver electronics, catch diodes and basic feedback electronics) are the same as discussed in the FIGS. 8–9 embodiment.

The embodiments disclosed in FIGS. 8–10 are particularly suited for the 4 solenoid-valve regulator embodiment of FIG. 5. These embodiments were block diagrammed with but four solenoids and valves only to simplify the disclosure. Each is made specifically applicable to the FIG. 1 embodiment by merely increasing the number of solenoids 28, valves 30 and related essential circuitry from four to six.

Returning again to FIG. 1, it can be seen that the diameter (and thus area) of each valve opening 30 is the same. Given the digital nature of the ESR and resultant problems in controlling but a single valve 30 with multiple inputs, it was decided to adopt multiple orifices (four in FIG. 5; six in FIG. 1). Their opening and closing could be controlled in three ways. First, have all the orifices the same size and then vary the time each is opened, in a montonic increasing ratio of 1:2:4:8, etc. For example, the "8" solenoid-valve would be held open eight times longer than the "1" solenoid-valve thus delivering eight times as much air. Second, have similar sized orifices but vary the stroke length of the solenoids on a ratio of 1:2:4:8, etc. Third, all solenoids have the same duty cycle but the opening of the valve orifices varies on the same ratio, 1:2:4:8, etc.

The variable duty cycle approach (the first option) presents frequency of cycling problems at high repetitive rates that create mechanical difficulties and thus is not preferred. The second option of fixed orifice—echeloned solenoid stroke is slightly preferred over the third option of echeloned orifice size—fixed solenoid stroke since there are power savings and fewer mechanical movement requirements. However, either option could very well be used.

FIGS. 12–17 inclusive illustrate the invention applied to a scuba regulator first stage. The electronic scuba regulator (ESR) as described hereinbefore is designed to supply a diver with gas on demand. The ESR demand stage may be made to supply gas at a constant intermediate pressure provided only that provision is made for a datum input. In scuba a gas regulator so modified to supply gas at an intermediate pressure as controlled by a datum force is called a scuba first stage.

Attention is now directed to the two chamber arrangement shown in FIGS. 12 and 13, illustrating a scuba first stage 300. Chamber 300 containing solenoids 304 is in the high pressure section and communicates through high pressure port 306 with a source of high pressure gas (e.g., a conventional tank of air at a pressure of 2500 psi or greater). DTIU 16' is in the intermediate pressure chamber 308. One side (the inside of the DTIU 16' diaphragm is exposed to the intermediate pressure chamber, and the other side (the outside) of the DTIU 16' diaphragm is exposed to the directly applied datum force and the external ambient forces. In the initial state, assume the intermediate pressure chamber 308 to be unpressurized. The coils are connected to the ESR electronics, and communicate with the DTIU 16' in precisely the same manner as was described for the ESR "demand" mode of operation. When the datum force is applied, the DTIU 16' diaphragm will be forced inward into the intermediate pressure chamber 308. The DTIU 16' will, therefore, register an "error" signal which will be communicated to the ESR electronics which, in turn, controls the solenoid valves 304. The electronics will, therefore, cause the solenoid valves 304 to open, thereby allowing some high pressure gas to flow into intermediate chamber 308. As high pressure gas fills up the intermediate pressure chamber 308, the gas begins to exert a restoring force on the DTIU 16' diaphragm from inside chamber 302 toward the outside of chamber 302. This restoring force causes the DTIU 16' to register less of an error signal and the controlling ESR electronics proceeds to close some of the solenoid valves 304, thereby reducing the rate at which high pressure gas flows into intermediate pressure chamber 308. This process continues until the DTIU 16' internal forces exactly balance the external datum forces acting externally on the DTIU 16' diaphragm. In order for this to happen, the internal pressure must hold the diaphragm in equilibrium with the datum forces. If now, the datum force has added to it an ambient force (such as environmental water pressure for example), the internal pressure in intermediate chamber 308 will be adjusted by the electronics and the solenoid valves 304 to restore equilibrium at the DTIU 16 diaphragm, against both the datum and the ambient forces acting on the diaphragm.

A more detailed illustration of an embodiment of these principles in the form of a first stage regulator is shown in FIG. 12. Scuba regulator first stage 300 includes a central, cylindrical body 310 defining chambers 302 and 308 therewithin, an end chamber 312 ported as at 314 to admit ambient, external pressure (such as water) into end chamber 312 and yoke assembly 316 shown mounted on a conventional valve stem 318 of a high pressure cylinder or air tank (not shown). High pressure air is admitted through port 306 to high pressure chamber 302. Solenoid valves 304 are clustered within chamber 302 as shown best in dotted lines in FIG. 14. Additionally, orifices 320 of the solenoid valves 304 are echeloned in size and function according to the echeloned-orifice-fixed solenoid stroke embodiment hereinbefore described. The varying size of orifices 320 is best illustrated in FIG. 14; the diameter of the six orifices 320 may vary, for example, from 0.001" to 0.032" in diameter, the intermediate dimensions being 0.002"; 0.004"; 0.008"; and 0.016", respectively. Main body 310 may also be provided with one or more high pressure ports 322 which may be conventionally plugged when not in use (not shown) or fitted to one or more other devices such as a submersible pressure gauge, high pressure power tool, etc.

Intermediate pressure chamber 308 is defined within the right hand side of main body 310 and may be provided with one or more low pressure ports 324 which are also conventionally plugged when not in use (not shown). One of these ports 324 will, of course, be fitted with intermediate pressure hose 12 leading to the scuba regulator second stage (FIG. 1). Other ports 324 may be used for a redundant second stage (or "octopus" regulator), a power inflator for a diver's buoyancy compensator, etc.

DTIU 16' is mounted at the extreme right of main body 310 and, in this embodiment, is cylindrical in shape. DTIU 16' is concentrically mounted within a cage 326 (FIG. 15) which is seated against a retaining lip or ring 328 formed interiorally of main body 310. Cage 326 is apertured at 328 so that intermediate pressure air is communicated to the right hand side (FIG. 12) of DTIU 16'. Except for external configuration, DTIU 16' is the same in structure as DTIU 16 described above in the first embodiment of the invention.

Yoke assembly 316 and main body 310 are provided with mating peripheral flanges 330 and 332, respectively, which are bolted together as shown with a circular pin-out disc 334 being sandwiched therebetween. The structure and function of pin-out disc 334 is described hereinbelow. Similarly, end chamber 312 and the end of main body 310 opposite flange 332 are also provided with mating peripheral flanges 336 and 338, respectively, which are bolted together as shown with a second pin-out disc 340 being sandwiched therebetween. The structure and function of disc 340 is also described hereinbelow. These respective flange assemblies may be O-ring sealed in conventional fashion to prevent water ingress or high pressure egress with respect to first stage 310.

Referring now to the right hand side of FIG. 12 and FIG. 17, a circular diaphragm 342 having a contact button 344 fixed centrally therein is retained within end chamber 312 and in contact with DTIU 16' by means of a retaining ring 346 threaded with end chamber 312.

Diaphragm 342 has an extremely limited travel movement and thus may be fabricated of stainless steel or other sturdy material. An O-ring seal 348 (FIG. 17) may be fitted about the periphery of diaphragm 342 to pressure seal the same within end chamber 312.

As set forth above, the electronic structure and function of DTIU 16' is exactly the same as that of DTIU 16. The only difference (other than external configuration) between DTIU 16 and DTIU 16' is in the inputs applied. One force applied is ambient water pressure, directly in the case of DTIU 16 and through diaphragm 342 and button 344 in the case of DTIU 16'. The second force applied is diver inspiration demand (DTIU 16) while in this embodiment, a datum force is applied by an adjusting screw 350 acting through a compression spring 352 seated against button 344 of diaphragm 342. Screw 350 is adjusted to set a predetermined equilibrium pressure within intermediate pressure diameter 308 (100 to 150 psi over ambient as explained hereinbefore). The processing electronics between DTIU 16' and the cluster of solenoid valves 304 are precisely the same as those of the first embodiment set forth above. Thus when pressure is reduced within chamber 308, as by diver demand on the second stage (FIG. 1) or use of a power inflator (not shown), the signal generated by the change in equilibrium of DTIU 16' will cause valves 304 to open so that high pressure air is admitted to intermediate pressure chamber 308. Once sufficient air is admitted to balance the internal air pressure force in chamber 308 (transmitted to the left side of diaphragm 342 through apertures 328 in cage 326) against the external forces generated by ambient pressure and spring 352, the electronic servomechanism causes valves 304 to close.

Each pin-out disc 334, 340 is provided to allow electrical connections to be made from solenoid valves 304 and DTIU 16', respectively, through the sidewalls of first stage 300 to an exterior location for connection to the processing electronics of the invention. Each disc 334, 340 is a printed circuit including a lamination of insulation layers 354 between which are sandwiched electrical conductors 356 made of copper or other suitable material, all as illustrated in FIG. 17. The conductor areas of the exterior portions of the discs may be bored as at 358 (FIGS. 14, 15 and 17) for electrical connection to the processing electronics (not shown). Of course, these external electrical connections, once made, may be potted or otherwise suitably encased for purposes of protection and insulation.

The processing electronics disclosed herein may be time shared between the disclosed first and second stages. Alternatively, a duplicate processing electronics system may be provided for the first stage and, for safety purposes, the two systems could be configured so that upon failure of one, the other will go into a sharing mode to thus power both stages of the regulator. In yet another embodiment, the redundant processing electronics systems may be cross strapped so that upon failure of a component of one system, the duplicate component of the other system will be employed for both systems. Such cross strapping provides an obvious multifold safety factor.

Although the invention herein disclosed has particular relevance to single hose, two stage scuba regulators, it has obvious application to a wide variety of other breathing systems. For example, the invention may be employed in closed circuit or semi-closed circuit systems and in surface supplied systems employing a surface located primary regulator and an underwater demand breathing system. Representative examples of such systems include the Kirby Morgan KMB-10, the Super Lite 17 and the Aquadyne Air Hat.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A breathing gas system having a demand regulator and valve means for delivery of breathable gas to a recipient on demand including: means electronically sensing pneumatic demand created by the recipient and converting said demand into an electrical output signal; electronic processing means for converting said electrical signal into a first digital word address; electronic driver means for opening and closing said valve means to deliver breathable gas at ambient pressure to the recipient on demand and controlled by said first digital word address; and means for preventing runaway gas blast instability which would otherwise occur due to the response lag between the pneumatic and electronic components of the system, comprising electronic feedback means tapped into said electronic driver means for sensing the electronic driver means output and converting it into a second digital word address and logic means for interpreting said first and second digital word addresses and creating an output to further control said electronic driver means and thus said valve means to provide breathable gas at ambient pressure in response to recipient demand and electronic driver means delivery.

2. The breathing gas system claimed in claim 1 wherein said sensing means comprise a differential transformer having an iron slug movable within the transformer core in response to pneumatic demand to thereby unbalance said transformer and create an alternating current, output signal.

3. The breathing gas system claimed in claim 1, said valve means further comprising a plurality of valves for delivering ambient pressure gas to the recipient.

4. The breathing gas system claimed in claim 3 wherein said valves have orifices of equal size.

5. The breathing gas system claimed in claim 3 wherein said valves have orifices of unequal size.

6. The breathing gas system claimed in claim 1 wherein said logic means comprise an arithmetic logic unit for differencing inputs from said first and second digital word addresses and producing an output digital word to control said driver electronics.

7. The breathing gas system claimed in claim 1 wherein said logic means comprise random variable logic means controlled by said first and second digital word addresses for producing an output digital word to control said driver electronics.

8. A method of controlling gas delivered through a demand regulator to a receiver in a breathing gas system comprising the steps of: sensing pneumatic demand in said regulator; converting said sensed demand to an electrical signal; converting said electrical signal to a digital word address; controlling delivery of gas to said receiver by said digital word address; and preventing runaway gas blast instability which would otherwise occur due to the response lag between the gas delivery and electronic response steps of the method, comprising the further steps of electronically tapping said digital word address as it controls gas delivery, converting said electronic tapping to an additional digital word address, and differencing said digital word address and said additional digital word address to create an output digital word to further regulate the said delivery of gas to said receiver.

9. A breathing gas system having a primary regulator and valve means for delivery of gas to at least one additional regulator which comprises breathing gas delivery means adapted to be connected to a recipient, said primary regulator including: means electronically sensing a datum input and converting said datum input into an electrical output signal; electronic processing means for converting said electrical signal into a first digital word address; electronic driver means for opening and closing said valve means to deliver gas at ambient plus a predetermined pressure to said additional regulator and controlled by said first digital word address; and means for preventing runaway gas blast instability which would otherwise occur due to the response lag between the pneumatic and electronic components of the system, comprising electronic feedback means tapped into said electronic driver means for sensing the electronic driver means output and converting it into a second digital word address and logic means for interpreting said first and second digital word addresses and creating an output to further control said electronic driver means and thus said valve means to provide gas at ambient plus a predetermined pressure in response to said datum input and driver means delivery.

10. The breathing gas system claimed in claim 9 wherein said sensing means comprise a differential transformer having an iron slug movable within the transformer core in response to pneumatic demand to thereby unbalance said transformer and create an alternating current, output signal.

11. The breathing gas system claimed in claim 9, said valve means further comprising a plurality of valves for delivering ambient plus a predetermined pressure gas to said additional regulator.

12. The breathing gas system claimed in claim 11 wherein said valves have orifices of unequal size.

13. The breathing gas system claimed in claim 9 wherein said logic means comprise an arithmetic logic unit for differencing inputs from said first and second digital word addresses and producing an output digital word to control said driver electronics.

14. The breathing gas system claimed in claim 9 wherein said logic means comprise random variable logic means controlled by said first and second digital word addresses for producing an output digital word to control said driver electronics.

15. The breathing gas system claimed in claim 9 further comprising a demand regulator receiving gas at ambient plus a predetermined pressure, said demand regulator having valve means for delivery of breathable gas at ambient pressure to a recipient on demand.

16. A method of controlling gas delivered through a primary regulator to an additional regulator in a breathing gas system comprising the steps of: applying a datum input control in said regulator; converting said datum input to an electrical signal; converting said electrical signal to a digital word address; controlling delivery of gas from the regulator by said digital word address; and preventing runaway gas blast instability which would otherwise occur due to the response lag between the gas delivery and electronic response steps of the method, comprising the further steps of electronically tapping said digital word address as it controls gas delivery, converting said electronic tapping to an additional digital word address, and differencing said digital word address and said additional word address to create an output digital word to further regulate the said delivery of gas from said primary regulator.

* * * * *